US011906226B2

(12) United States Patent
Wallet-Laïly et al.

(10) Patent No.: US 11,906,226 B2
(45) Date of Patent: Feb. 20, 2024

(54) DUAL COMPRESSOR HEAT PUMP

(71) Applicant: Carrier Corporation, Palm Beach Gardens, FL (US)

(72) Inventors: Jeremy Wallet-Laïly, Saint Cyr au mont d'or (FR); Ahmad M. Mahmoud, Bolton, CT (US); Parmesh Verma, South Windsor, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 587 days.

(21) Appl. No.: 17/044,009

(22) PCT Filed: Mar. 14, 2019

(86) PCT No.: PCT/US2019/022193
§ 371 (c)(1),
(2) Date: Sep. 30, 2020

(87) PCT Pub. No.: WO2019/203963
PCT Pub. Date: Oct. 24, 2019

(65) Prior Publication Data

US 2021/0033315 A1 Feb. 4, 2021

Related U.S. Application Data

(60) Provisional application No. 62/658,493, filed on Apr. 16, 2018.

(51) Int. Cl.
*F25B 13/00* (2006.01)
*F25B 41/24* (2021.01)
(Continued)

(52) U.S. Cl.
CPC ..... *F25B 9/006* (2013.01); *F25B 13/00* (2013.01); *F25B 41/24* (2021.01); *F25B 49/022* (2013.01);
(Continued)

(58) Field of Classification Search
CPC ..... F25B 9/006; F25B 13/00; F25B 49/025; F25B 49/022; F25B 2400/075;
(Continued)

(56) References Cited

U.S. PATENT DOCUMENTS 3,723,024 A 3/1973 Sawai et al.
4,141,708 A * 2/1979 Lavigne, Jr. ..... F25B 1/053 62/505
(Continued)

FOREIGN PATENT DOCUMENTS

CN 1720420 A 1/2006
CN 1950613 A 4/2007
(Continued)

OTHER PUBLICATIONS

WO-2005114064-A1 English Translation (Year: 2005).*
(Continued)

*Primary Examiner* — David J Teitelbaum
*Assistant Examiner* — Devon Moore
(74) *Attorney, Agent, or Firm* — Bachman & LaPointe, P.C.

(57) ABSTRACT

A vapor compression system (20; 120; 220; 320) has: first (22A; 122A; 222A) and second (22B; 122B; 222B) compressors; first (40) and second (46) heat exchangers; and one or more expansion devices (52; 52A, 52B). Means (32A, 32B; 32A, 32B, 126A, 126B; 32A, 32B, 232A, 232B) are provided for switching the system between operation in first and second modes using the respective first and second compressors. In the first mode: the first compressor compresses refrigerant; the compressed refrigerant is cooled in the first heat exchanger; the cooled refrigerant is expanded in at least one of the one or more expansion devices; and the expanded refrigerant absorbs heat in the second heat exchanger. In the second mode: the second compressor
(Continued)

compresses refrigerant; the compressed refrigerant is cooled in the second heat exchanger; the cooled refrigerant is expanded in at least one of the one or more expansion devices; and the expanded refrigerant absorbs heat in the first heat exchanger.

20 Claims, 4 Drawing Sheets

(51) Int. Cl.
*F25B 9/00* (2006.01)
*F25B 49/02* (2006.01)

(52) U.S. Cl.
CPC ... *F25B 2313/003* (2013.01); *F25B 2313/004* (2013.01); *F25B 2313/027* (2013.01); *F25B 2400/075* (2013.01); *F25B 2600/2513* (2013.01)

(58) Field of Classification Search
CPC ..... F25B 2400/0751; F25B 2313/003; F25B 2313/004; F25B 2313/027; F25B 2600/2513; F25B 2600/02; F25B 1/00; F25B 2700/193
See application file for complete search history.

(56) References Cited

U.S. PATENT DOCUMENTS

| | | | | |
|---|---|---|---|---|
| 4,702,088 | A | 10/1987 | Ozu | |
| 4,787,211 | A * | 11/1988 | Shaw | F25B 49/022 417/248 |
| 5,121,610 | A | 6/1992 | Atkinson et al. | |
| 5,150,582 | A | 9/1992 | Gotou | |
| 5,203,179 | A * | 4/1993 | Powell | F25B 49/022 62/216 |
| 5,323,844 | A | 6/1994 | Sumitani et al. | |
| 5,628,201 | A | 5/1997 | Bahel et al. | |
| 6,227,003 | B1 | 5/2001 | Smolinsky | |
| 7,013,666 | B2 | 3/2006 | Park et al. | |
| 8,191,376 | B2 | 6/2012 | Fox et al. | |
| 8,459,051 | B2 | 6/2013 | Jeong et al. | |
| 2005/0188708 | A1 | 9/2005 | Wills et al. | |
| 2006/0065003 | A1 | 3/2006 | Kim | |
| 2006/0156751 | A1 | 7/2006 | Hwang et al. | |
| 2006/0225445 | A1 * | 10/2006 | Lifson | F25B 1/10 62/175 |
| 2010/0263393 | A1 * | 10/2010 | Chen | F25B 1/10 62/434 |
| 2016/0195311 | A1 | 7/2016 | Li et al. | |

FOREIGN PATENT DOCUMENTS

| | | | | |
|---|---|---|---|---|
| DE | 60128827 | T2 | 2/2008 | |
| EP | 0668474 | A2 | 8/1995 | |
| JP | S52136444 | A | 11/1977 | |
| JP | S5672281 | A | 6/1981 | |
| JP | 2002266772 | A | 9/2002 | |
| KR | 20140122796 | A | 10/2014 | |
| WO | WO-2005114064 | A1 * | 12/2005 | F25B 27/00 |
| WO | WO-2009048464 | A1 * | 4/2009 | F25B 49/022 |
| WO | WO-2015089362 | A1 * | 6/2015 | F25B 1/04 |

OTHER PUBLICATIONS

Chinese Office Action dated Jan. 4, 2022 for Chinese Patent Application No. 201980026459.X.
Chinese Office Action dated Aug. 2, 2022 for Chinese Patent Application No. 201980026459.X.
International Search Report and Written Opinion dated Jul. 2, 2019 for PCT/US2019/022193.
"Ranco 4-Way Reversing Valves", Feb. 2006, Invensys Controls Europe, Belluno, Italy.

* cited by examiner

DUAL COMPRESSOR HEAT PUMP

CROSS-REFERENCE TO RELATED APPLICATION

Benefit is claimed of U.S. Patent Application No. 62/658,493, filed Apr. 16, 2018, and entitled "Dual Compressor Heat Pump", the disclosure of which is incorporated by reference herein in its entirety as if set forth at length.

BACKGROUND

The disclosure relates to heat pumps. More particularly, the disclosure relates to heat pumps for use with low pressure refrigerants.

Some vapor compression systems are configured to alternatively operate in a heating mode and a cooling mode. For example, in a residential heat pump situation, a cooling mode involves a compressor receiving refrigerant from an indoor heat exchanger and compressing that refrigerant. The compressed refrigerant passes through an outdoor heat exchanger where it rejects heat and is condensed. The condensed refrigerant passes through an expansion device and further cools. The expanded/cooled refrigerant absorbs heat in the indoor heat exchanger.

In a heating mode, the compressor receives and compresses refrigerant from the outdoor heat exchanger. The compressed refrigerant rejects heat in the indoor heat exchanger before passing rough the expansion device and outdoor heat exchanger.

Commercial chiller units have similar mode switching, but have one or both of the heat exchangers as refrigerant-water heat exchangers.

To facilitate switchover between cooling and heating modes, the system will typically include a four-way switching/reversing valve or an alternative combination of two-way and/or three-way valves.

Efforts have been made to develop systems using low global warming potential (GWP) refrigerants. One example of a low-GWP refrigerant is R1233zd(E) (hereafter simply "R1233zd"). Whereas, R410A has a direct GWP of 2088, R1233zd has a direct GWP of less than 1.0. R1233zd also has a higher cycle efficiency than R410A (e.g., by about 10% to 15%) due to lower discharge temperatures and lower expansion losses. Nevertheless, R1233zd suffers from being a low pressure refrigerant. A low pressure refrigerant is defined by the United States Environmental Protection Agency (EPA) as having a saturation pressure less than 45 psia (310 kPa) (R1233zd has a saturation pressure of 31 psia (214 kPa)) at 104° F. (40° C.). Low pressure refrigeration systems typically operate at evaporator pressures (thus compressor suction pressures) less than atmospheric pressure or the ambient pressure which might slightly differ from 1 ATM due to weather, altitude, etc.

R410A (saturation pressure 352 psia (2.43 MPa) at 104° F. (40° C.)) is a high-pressure refrigerant (saturation pressure 170 psia (1.17 MPa) to 355 psia (2.45 MPa) at 104° F. (40° C.)). R134a (saturation pressure 147 psia (1.01 MPa) at 104° F. (40° C.)) is a medium pressure refrigerant (saturation pressure 45 psia (310 kPa) to 170 psia (1.17 MPa) at 104° F. (40° C.)).

R1233zd also has benefits of being non-flammable and nontoxic (rating A1 under ASHRAE Standard 34-2007; with "A" indicating non-toxic and "1" indicating non-flammability).

SUMMARY

One aspect of the disclosure involves a vapor compression system comprising: a first compressor; a second compressor; a first heat exchanger; a second heat exchanger; and one or more expansion devices. Means are provided for switching the system between operation in a first mode and a second mode. In the first mode: the first compressor compresses refrigerant; the compressed refrigerant is cooled in the first heat exchanger; the cooled refrigerant is expanded in at least one of the one or more expansion devices; the expanded refrigerant absorbs heat in the second heat exchanger and returns to the first compressor; and the second compressor is offline. In the second mode: the second compressor compresses refrigerant; the compressed refrigerant is cooled in the second heat exchanger; the cooled refrigerant is expanded in at least one of the one or more expansion devices; the expanded refrigerant absorbs heat in the first heat exchanger and returns to the second compressor; and the first compressor is offline.

In one or more embodiments of any of the foregoing embodiments, the first compressor and the second compressor share an inverter.

In one or more embodiments of any of the foregoing embodiments, the first compressor and the second compressor share a motor.

In one or more embodiments of any of the foregoing embodiments, the first compressor and the second compressor are respectively coupled to the motor by a first clutch and a second clutch.

In one or more embodiments of any of the foregoing embodiments, the first heat exchanger is an outdoor heat exchanger and the second heat exchanger is an indoor heat exchanger.

In one or more embodiments of any of the foregoing embodiments, the first heat exchanger is a refrigerant-air heat exchanger.

In one or more embodiments of any of the foregoing embodiments, the second heat exchanger is a refrigerant-liquid heat exchanger.

In one or more embodiments of any of the foregoing embodiments, the second heat exchanger is a refrigerant-air heat exchanger.

In one or more embodiments of any of the foregoing embodiments, the second compressor has a pressure ratio at least 1.25 times a pressure ratio of the first compressor.

In one or more embodiments of any of the foregoing embodiments, the first compressor is a scroll compressor; and the second compressor is a screw compressor or a centrifugal compressor.

In one or more embodiments of any of the foregoing embodiments, the first compressor and the second compressor are both screw compressors; or the first compressor and the second compressor are both centrifugal compressors.

In one or more embodiments of any of the foregoing embodiments, the one or more expansion devices comprise: a first expansion device not passing refrigerant in the second mode; and a second expansion device not passing refrigerant in the first mode.

In one or more embodiments of any of the foregoing embodiments, the system contains a low pressure refrigerant.

In one or more embodiments of any of the foregoing embodiments, the system is a chiller.

In one or more embodiments of any of the foregoing embodiments, a method for using the system comprises: running the system in the first mode; and running the system in the second mode.

In one or more embodiments of any of the foregoing embodiments, the first mode is a cooling mode and the second mode is a heating mode.

In one or more embodiments of any of the foregoing embodiments, in at least one of the first mode and the second mode, a compressor suction pressure is less than an ambient pressure.

Another aspect of the disclosure involves a method for operating a vapor compression system. The vapor compression system comprises: a first compressor; a second compressor; a first heat exchanger; a second heat exchanger; and one or more expansion devices. The method comprises running the system in a first mode and running the system in a second mode. In the first mode: the first compressor compresses refrigerant; the compressed refrigerant is cooled in the first heat exchanger; the cooled refrigerant is expanded in at least one of the one or more expansion devices; the expanded refrigerant absorbs heat in the second heat exchanger and returns to the first compressor; and the second compressor is offline. In the second mode: the second compressor compresses refrigerant; the compressed refrigerant is cooled in the second heat exchanger; the cooled refrigerant is expanded in at least one of the one or more expansion devices; the expanded refrigerant absorbs heat in the first heat exchanger and returns to the second compressor; and the first compressor is offline.

In one or more embodiments of any of the foregoing embodiments, the first mode is a cooling mode and the second mode is a heating mode.

In one or more embodiments of any of the foregoing embodiments, in at least one of the first mode and the second mode, a compressor suction pressure is less than an ambient pressure.

In one or more embodiments of any of the foregoing embodiments, switching between the first mode and the second mode comprises switching a single inverter between powering the first compressor and the second compressor; and said switching between the first mode and the second mode does not involve use of a four-way reversing valve.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Low pressure refrigerants pose problems for use in systems having four-way reversing valves due to large valve size and associated losses. As is discussed below, a set of compressors and valves are used to accomplish the function of a traditional four-way reversing valve and facilitate heat pump operation. In typical state-of-the-art reversible heat pumps multiple compressors are already used to meet capacity and/or operational envelope. With low pressure refrigerants, current technology would require multiple compressors (either in parallel or in series) in order to meet the design envelope associated with the dramatic change of thermodynamic properties. Low pressure refrigerants require compression at higher pressure ratios than do high pressure refrigerants. Lower pressure refrigerants may require a greater spread between the lowest cooling mode pressure ratio and the highest heating mode pressure ratio than do high pressure refrigerants.

Figure 2:
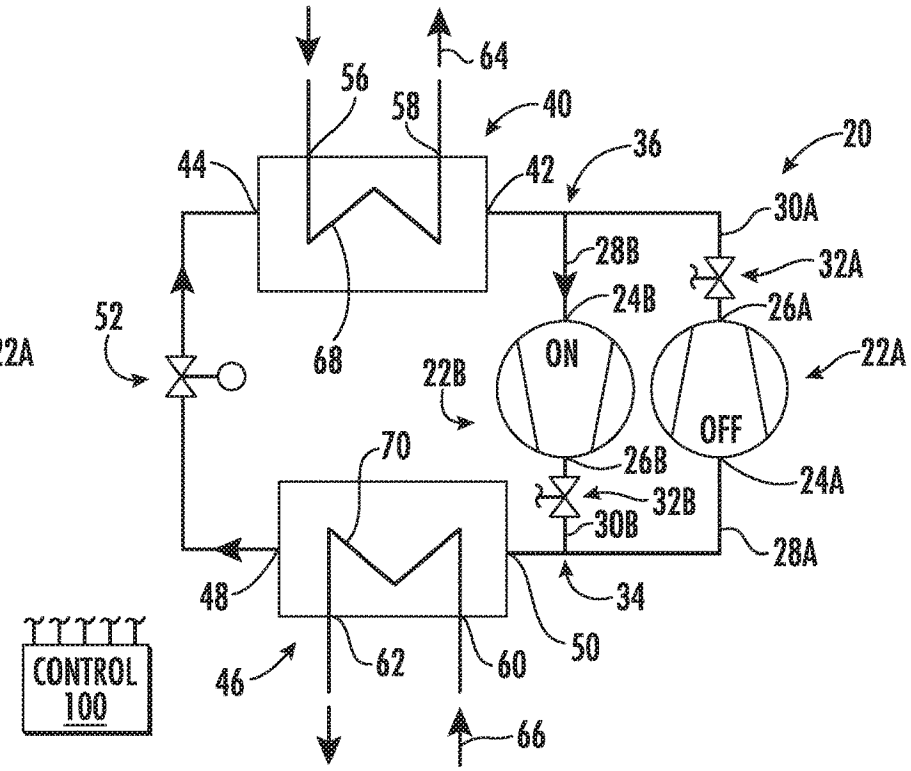
FIG. 2 is a schematic view of the first vapor compression system in a heating mode.
Figure 1:
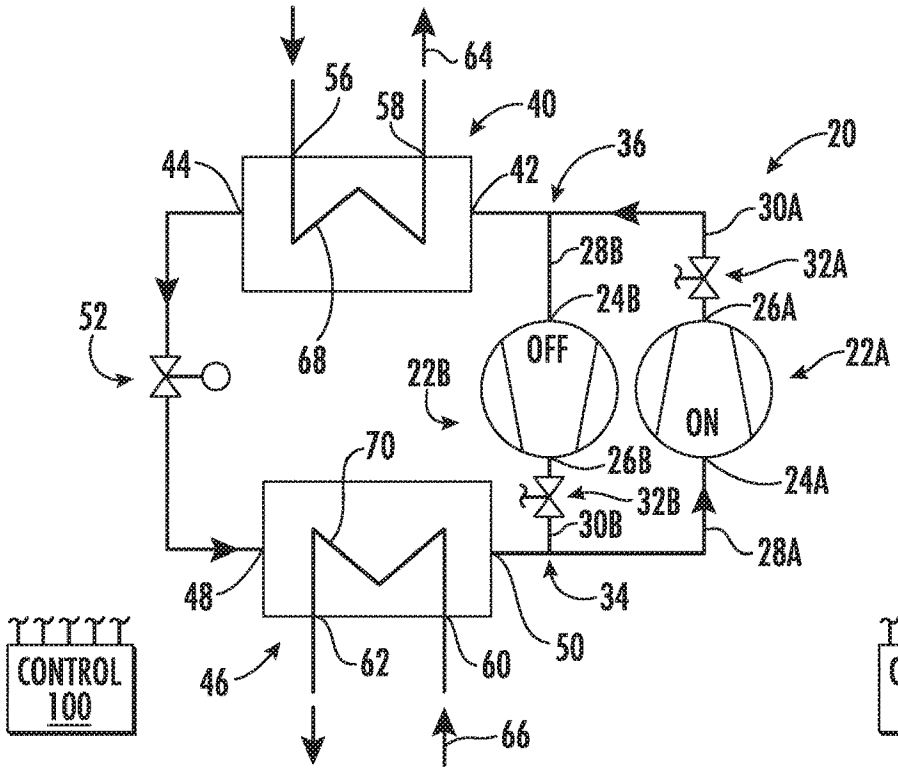
FIG. 1 is a schematic view of a first vapor compression system in a cooling mode.
Figure 4:
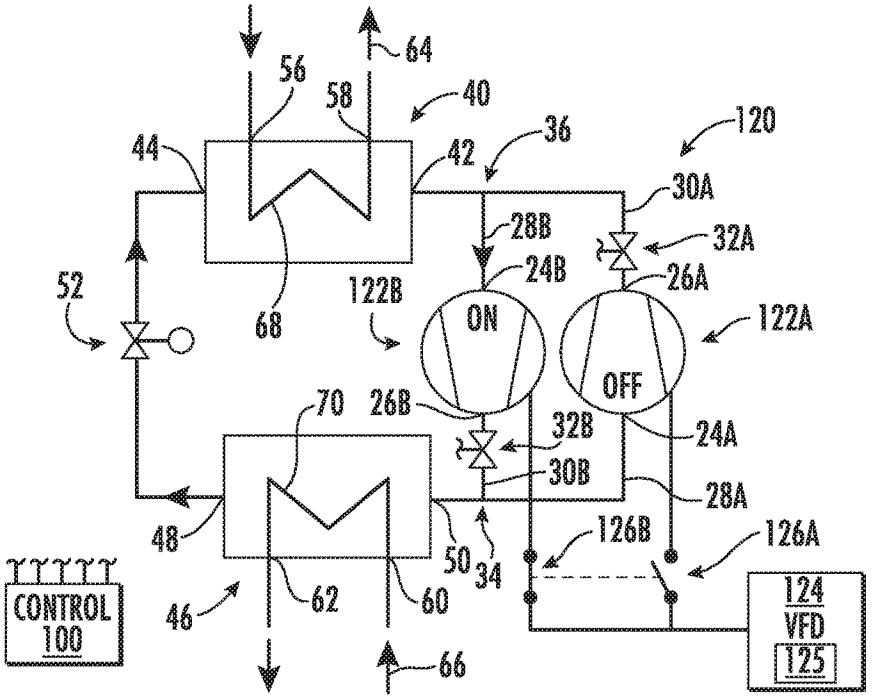
FIG. 4 is a schematic view of the second vapor compression system in a heating mode.

FIG. 1 shows a vapor compression system 20 with flow arrows showing operation in a cooling mode. FIG. 2 shows the system 20 with flow arrows of a heating mode. The vapor compression system has a pair of compressors 22A, 22B. In the exemplary system, only the compressor 22A is run in the cooling mode and only the compressor 22B is run in the heating mode. Each exemplary compressor comprises a respective suction port or inlet 24A, 24B and discharge port or outlet 26A, 26B. Respective suction lines or conduits 28A, 28B feed the suction ports and discharge lines or conduits 30A, 30B pass refrigerant from the discharge ports. Respective control valves 32A, 32B are positioned along the associated discharge conduits to selectively block the discharge conduits when the associated compressor is not in operation. Thus, in the exemplary cooling mode, the valve 32A is open and the valve 32B is closed (to take the compressor 22B offline); whereas in the exemplary heating mode the valve 32A is closed (to take the compressor 22A offline) and the valve 32B is open. The exemplary first compressor suction line 28A and second compressor discharge line 30B (and associated flowpath segments) merge at a junction 34. Similarly, the exemplary first compressor discharge line 30A and second compressor suction line 28B merge at a junction 36.

FIG. 1 further shows a first heat exchanger 40 having a first refrigerant port 42 and a second refrigerant port 44 and a second heat exchanger 46 having a first refrigerant port 48 and a second refrigerant port 50. In the cooling mode, the ports 42 and 48 are respective refrigerant inlets along a refrigerant flowpath and the respective ports 44 and 50 are refrigerant outlets along the flowpath. Between the ports 44 and 48 is an expansion device 52. An exemplary expansion device is an electronic expansion valve (EEV).

The exemplary heat exchangers 40 and 46 are refrigerant-water heat exchangers wherein the refrigerant transfers heat with a liquid such as water, brine, or glycol. The term "refrigerant-water heat exchanger" is often used in the art when the heat transfer fluid is a liquid other than pure water. Thus, the first heat exchanger 40 has a pair of liquid ports 56, 58 and the second heat exchanger 46 has a pair of liquid ports 60, 62 for respectively passing liquid flows. The ports respectively pass flows 64 and 66 through the two heat exchangers along heat transfer legs 68, 70 in heat exchange relationship with the refrigerant flows through the respective heat exchanger.

In the cooling mode, refrigerant is compressed by the first compressor 22A and passes out the discharge port 26A along the discharge line 30, passing through the junction 36 to the port 42. Within the heat exchanger 40, the refrigerant rejects heat to the liquid flow 64 and exits the port 44. Typically, the refrigerant will condense in the heat exchanger 40. Thus, the heat exchanger 40 serves as a condenser so that vapor refrigerant enters the port 42 but liquid refrigerant exits the port 44.

The refrigerant passes from the port 44 through the refrigerant line to the expansion device 52 where it expands and its temperature drops. The refrigerant then passes into the second heat exchanger 46 via the port 48. In the second heat exchanger, the refrigerant absorbs heat from the liquid flow 66 and exits the port 50. In the second heat exchanger 46, the refrigerant evaporates so that the second heat exchanger functions as an evaporator. The refrigerant then passes through the junction 34 to the suction line 28A returning to the first compressor 22A to complete the compression cycle.

In the exemplary cooling mode, the liquid flow 66 may pass along a cooling loop to liquid-air heat exchangers throughout a building. The liquid 64 may pass to liquid-air heat exchangers outside to reject heat to an external environment.

In alternative embodiments, the first heat exchanger 40 may be a refrigerant-air heat exchanger directly discharging heat to external air (e.g., a fan-forced outdoor air flow driven by an electric fan (not shown)) in the cooling mode. The second heat exchanger 46 may still be a refrigerant-liquid heat exchanger as in a chiller (e.g., a heat pump chiller). Or the second heat exchanger may also be a refrigerant-air heat exchanger such as in a forced-air residential or commercial heat pump. An exemplary such commercial heat pump is a rooftop unit having a pull-through fan or a push-through fan to drive the outdoor/external air flow.

Similarly, in further variations, the liquid flow 66 may not directly absorb heat from the air within the building but may in turn serve as the heat absorbing fluid for individual further vapor compression systems operating with refrigerant-liquid condensers and refrigerant-air evaporators.

In the heating mode, however, the first compressor is off and the second compressor is on and the flow proceeds in a reverse direction through the ports of the two heat exchangers and the expansion device 52. Thus, the heat exchanger 46 serves as a heat rejection heat exchanger rejecting heat to the liquid 66 which in turn rejects heat in the liquid-air heat exchangers within the building. Similarly, the heat exchanger 40 serves as an evaporator absorbing heat.

The controller 100 may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The system may be made using otherwise conventional or yet-developed materials and techniques.

The two compressors may be optimized for respective cooling and heating mode operation. Asymmetries in the compressors are particularly relevant where a low pressure refrigerant is used (e.g., R1233zd or other low pressure refrigerant). A desired pressure ratio for the heating mode will be significantly higher than that for the cooling mode. Thus, for example, the pressure ratio of the second compressor 22B may be an exemplary 1.25 to 10.0 times, more particularly 2.0 to 10.0 times, that of the first compressor 22A (or at least 1.25 times or at least 2.0 times).

The exemplary compressors are each variable-capacity compressors. For such variable capacity compressors, the relative pressure ratios may be measured at the maximum pressure ratio of each compressor. Each compressor may have its own electric motor and inverter (not shown) coupled to external power. The compressors may be controlled by a controller 100. Although the compressors may be of the same general type as each other (e.g., centrifugal), two different types may be used. The cooling mode compressor 22A could be scroll or screw or a low- or medium-lift centrifugal compressor. The heating mode compressor 22B may be a screw or centrifugal compressor but not likely a scroll because high pressure ratios required at extreme heating conditions may require excessive scroll speeds in view of the large scroll size needed for low pressure refrigerants.

A particular example of a combination for use with medium pressure refrigerants (e.g., R134a and the like) is a scroll compressor for the first compressor and screw compressor or centrifugal compressor for the second compressor. With low pressure refrigerants, both are likely to be screw or centrifugal. There may be one of each type or both may be the same type.

Figure 3:
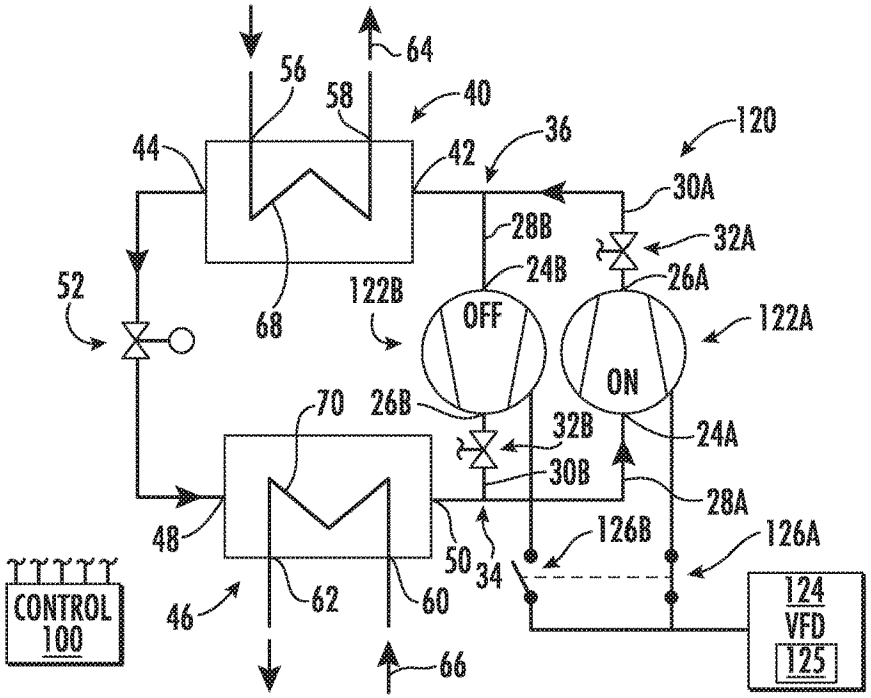
FIG. 3 is a schematic view of a second vapor compression system in a cooling mode.

FIG. 3 shows a system 120 operating in a cooling mode and otherwise similar to the system 20 except that the compressors 122A, 122B share a variable frequency drive 124 that includes the inverter. The VFD 124 may be connected to the motors of the respective compressors via respective switches 126A, 126B. The exemplary switch 126A is a normally closed switch and the exemplary switch 126B is a normally open switch. Switch opening/closing is controlled by the controller 100

Figure 6:
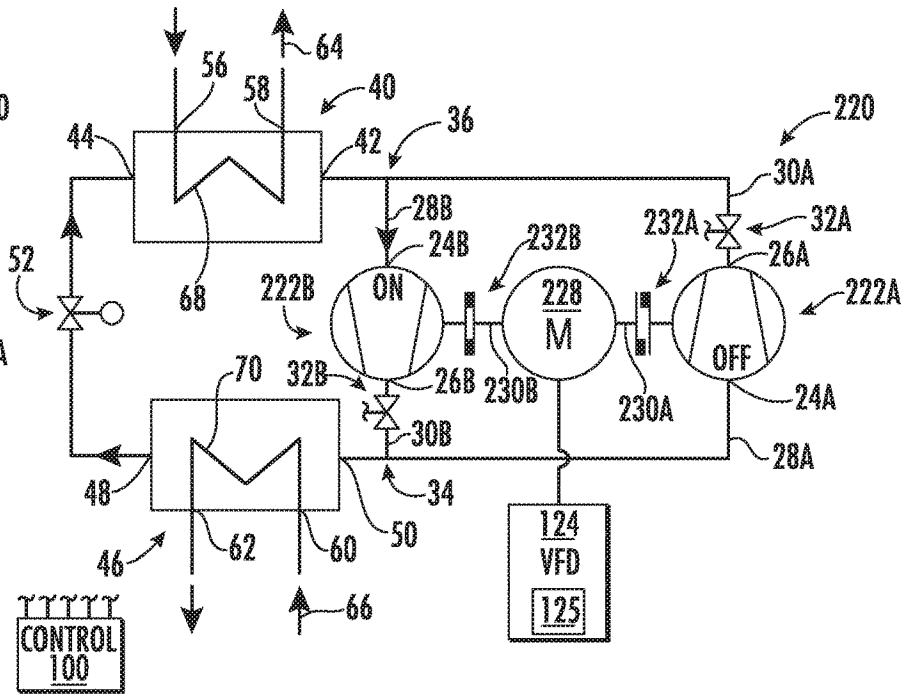
FIG. 6 is a schematic view of the third vapor compression system in a heating mode.
Figure 5:
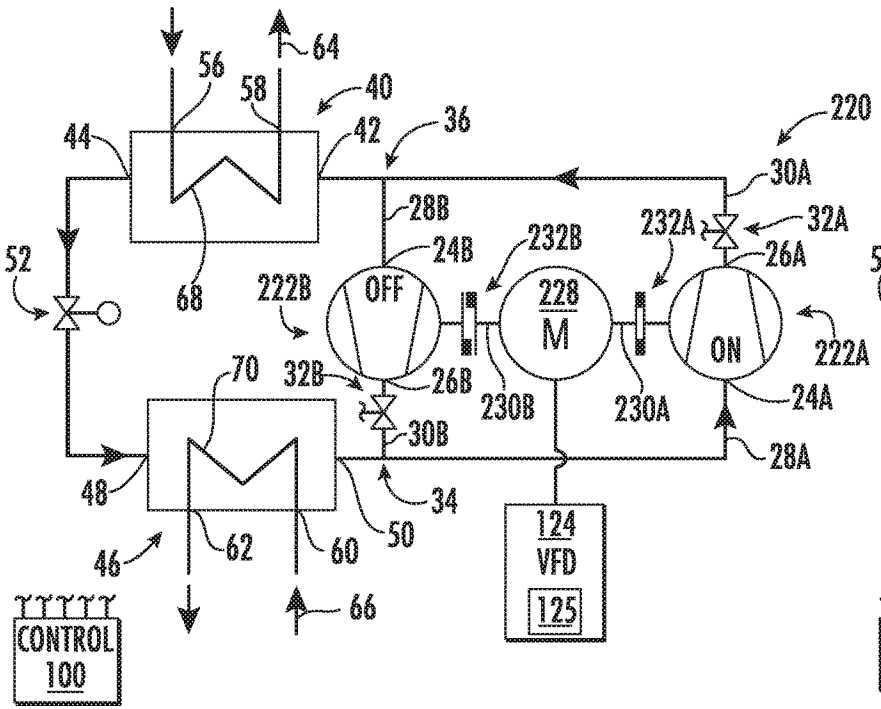
FIG. 5 is a schematic view of a third vapor compression system in a cooling mode.
Figure 8:
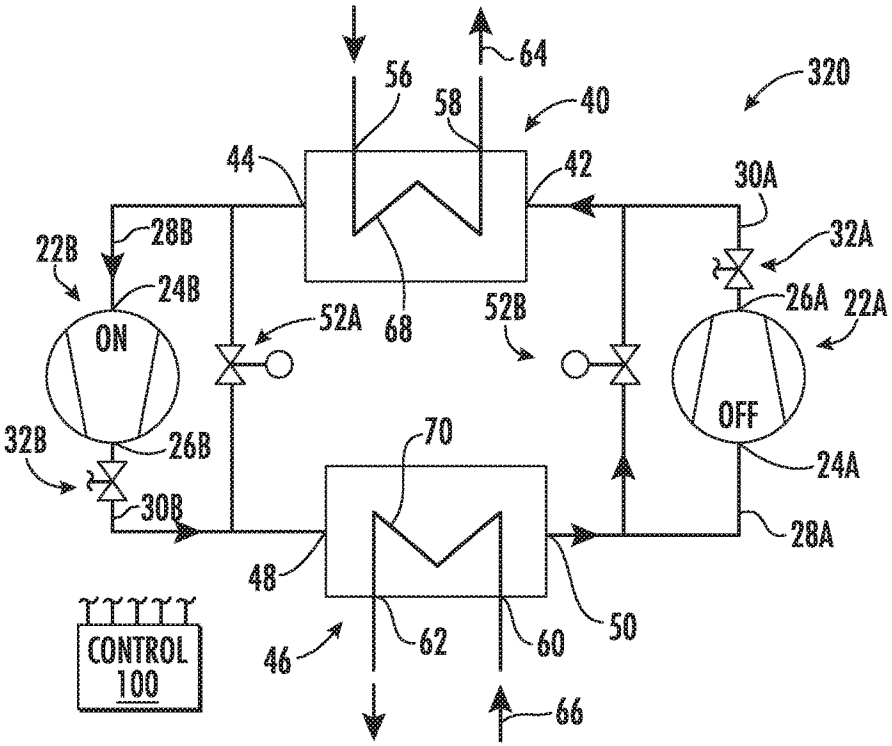
FIG. 8 is a schematic view of the fourth vapor compression system in a heating mode.

FIG. 5 shows a system 220 otherwise similar to the systems 20 and 120 but wherein the compressors 222A and 222B share a motor 228 in addition to the VFD 124. In the exemplary embodiment, the motor has a rotor with respective shaft end portions 230A, 230B coupled to respective clutches 232A, 232B. In the cooling mode, the clutch 232A is closed and the clutch 232B is open. In the heating mode (FIG. 6), the clutch 232A is open and the clutch 232B is closed. Clutch opening/closing is controlled by the controller 100.

Figure 7:
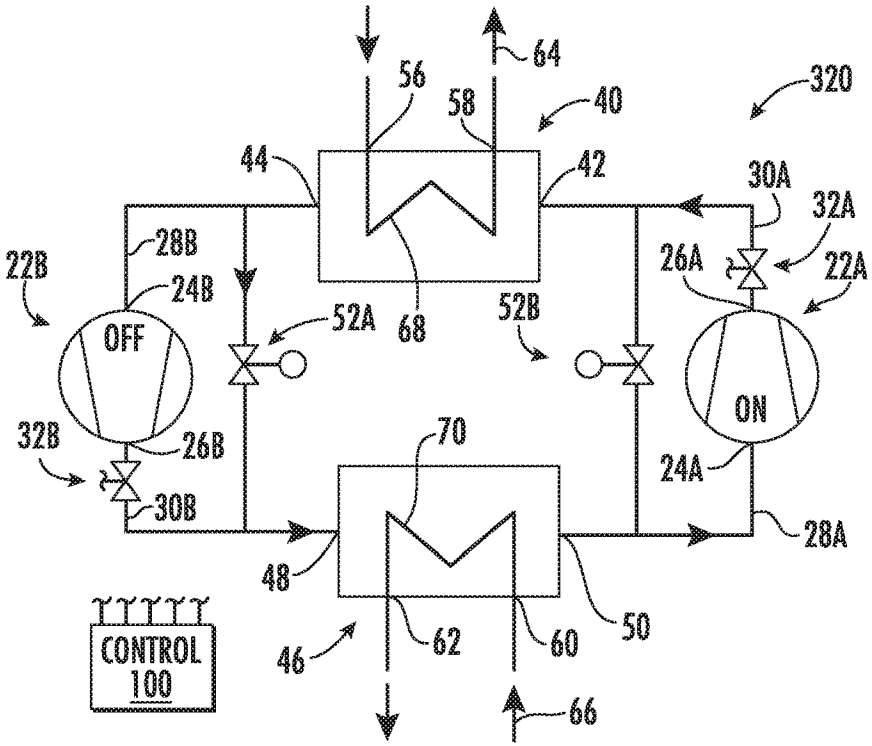
FIG. 7 is a schematic view of a fourth vapor compression system in a cooling mode.

FIG. 7 shows a system 320 otherwise similar to the system 20 except that the compressors are at opposite sides of the heat exchangers. Thus, the second compressor 22B and its valve are in parallel with an expansion device 52A used in the cooling mode while the first compressor 22A and its valve 32A are in parallel with a second expansion device 52B used exclusively in the heating mode. Thus, as in the system 20, the second compressor 22B is off and its valve 32B closed in the cooling mode and the first compressor 22A and its valve 32A are closed in the heating mode. In the cooling mode, also, the second expansion device 52B is in a closed condition. If the expansion device 52B does not close or does not fully close in its normal operation, an additional controllable valve (e.g., solenoid valve) may be placed in series with it to block flow through it in the cooling mode. Similarly, an additional valve may be placed in series with the expansion device 52A to prevent flow in the heating mode. Relative to the system 20, the system 320 facilitates use of differently sized expansion devices for the two modes. In general, expansion device size may increase or decrease along with the pressure ratio of the associated compressor. Thus, the second expansion device 52B may be larger than the first expansion device 52A. The relative size (e.g., measured at their maximal open condition) may be as given above for the relative pressure ratio.

There may be further variations on the system 320 as the systems 120 and 220 are on the system 20.

As noted above, whereas typical prior art heat pumps utilize four-way switching/reversing valves, the illustrated embodiments may avoid such valves. This presents a particularly significant advantage when working with low pressure refrigerants. When such a low pressure refrigerant is used, the four-way valve would have to be very large (thus expensive) and would impose significant energy losses. By using the two different compressors along with merely on-off valves (controllable valves (e.g., solenoid valves) and/or check valves), this expense and loss of efficiency may be avoided.

Additionally, in various implementations relative to compressors having switch over valves, the ability to tailor one compressor to each mode may further improve efficiency.

Although a single respective compressor is shown for each mode, one or both of the modes may have multiple compressors in series, parallel, or otherwise.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system (20; 120; 220) comprising:
- a first compressor (22A; 122A; 222A);
- a second compressor (22B; 122B; 222B);
- a first heat exchanger (40);
- a second heat exchanger (46);
- one or more expansion devices (52); and
- means (32A, 32B; 32A, 32B, 126A, 126B; 32A, 32B, 232A, 232B) for switching the system between operation in:
  - a first mode wherein:
    - the first compressor compresses refrigerant;
    - the compressed refrigerant is cooled in the first heat exchanger;
    - the cooled refrigerant is expanded in at least one of the one or more expansion devices;
    - the expanded refrigerant absorbs heat in the second heat exchanger and returns to the first compressor; and
    - the second compressor is offline; and
  - a second mode wherein:
    - the second compressor compresses refrigerant;
    - the compressed refrigerant is cooled in the second heat exchanger;
    - the cooled refrigerant is expanded in at least one of the one or more expansion devices;
    - the expanded refrigerant absorbs heat in the first heat exchanger and returns to the second compressor; and
    - the first compressor is offline, wherein:
- the first compressor has a suction line (28A);
- the first compressor has a discharge line (30A);
- the second compressor has a suction line (28B);
- the second compressor has a discharge line (30B);
- the first compressor suction line (28A) and second compressor discharge line merge at a first junction (34); and
- the first compressor discharge line and second compressor suction line merge at a second junction (36).

2. The system of claim 1 wherein:
- the first compressor and the second compressor share an inverter (125).

3. The system of claim 2 wherein:
- the first compressor and the second compressor share a motor (228).

4. The system of claim 3 wherein:
- the first compressor and the second compressor are respectively coupled to the motor by a first clutch (232A) and a second clutch (232B).

5. The system of claim 1 wherein:
- the first heat exchanger is an outdoor heat exchanger; and
- the second heat exchanger is an indoor heat exchanger.

6. The system of claim 5 wherein:
- the first heat exchanger is a refrigerant-air heat exchanger; and
- the second heat exchanger is a refrigerant-liquid heat exchanger.

7. The system of claim 1 wherein:
- the first compressor and the second compressor are the only compressors.

8. The system of claim 5 wherein:
- the second compressor has a pressure ratio at least 1.25 times a pressure ratio of the first compressor.

9. The system of claim 5 wherein:
- the first compressor is a scroll compressor; and
- the second compressor is a screw compressor or a centrifugal compressor.

10. The system of claim 5 wherein:
- the first compressor and the second compressor are both screw compressors; or
- the first compressor and the second compressor are both centrifugal compressors.

11. The system of claim 5 wherein:
- the first mode is a cooling mode and the second mode is a heating mode; and
- in the heating mode, refrigerant flow proceeds in a reverse direction through ports of the first and second heat exchangers and the at least one expansion device relative to the cooling mode.

12. The system of claim 1 wherein:
- the system is a chiller.

13. A method for using the system of claim 1, the method comprising:
- running the system in the first mode; and
- running the system in the second mode.

14. The method of claim 13 wherein:
- the first mode is a cooling mode and the second mode is a heating mode; and
- in the heating mode, refrigerant flow proceeds in a reverse direction through ports of the first and second heat exchangers and the at least one expansion device relative to the cooling mode.

15. A method for operating a vapor compression system (20; 120; 220), the vapor compression system comprising:
a first compressor (22A; 122A; 222A);
a second compressor (22B; 122B; 222B);
a first heat exchanger (40);
a second heat exchanger (46); and
one or more expansion devices (52);
the method comprising:
running the system in a first mode wherein:
the first compressor compresses refrigerant;
the compressed refrigerant is cooled in the first heat exchanger;
the cooled refrigerant is expanded in at least one of the one or more expansion devices;
the expanded refrigerant absorbs heat in the second heat exchanger and returns to the first compressor; and
the second compressor is offline; and
running the system in a second mode wherein:
the second compressor compresses refrigerant;
the compressed refrigerant is cooled in the second heat exchanger;
the cooled refrigerant is expanded in at least one of the one or more expansion devices;
the expanded refrigerant absorbs heat in the first heat exchanger and returns to the second compressor; and
the first compressor is offline,
wherein:
the first compressor has a suction flowpath merging with a discharge flowpath of the second compressor at a first junction (34);
the first compressor has a discharge flowpath merging with a suction flowpath of the second compressor at a second junction (36);
a first control valve (32A) is along the first compressor discharge flowpath; and
a second control valve (32B) is along the second compressor discharge flowpath;
in the first mode, the first control valve is open and the second control valve is closed; and
in the second mode, the first control valve is closed and the second control valve is open.

16. The method of claim 15 wherein:
the first mode is a cooling mode and the second mode is a heating mode.

17. The method of claim 15 wherein:
switching between the first mode and the second mode comprises switching a single inverter between powering the first compressor and the second compressor; and
said switching between the first mode and the second mode does not involve use of a four-way reversing valve.

18. The system of claim 15 wherein:
relative to the first mode, flow through the one or more expansion devices (52) in the second mode is in a reverse direction.

19. A vapor compression system (20; 120; 220) comprising:
a first compressor (22A; 122A; 222A);
a second compressor (22B; 122B; 222B);
a first heat exchanger (40);
a second heat exchanger (46);
one or more expansion devices (52); and
means (32A, 32B; 32A, 32B, 126A, 126B; 32A, 32B, 232A, 232B) for switching the system between operation in:
a first mode wherein:
the first compressor compresses refrigerant;
the compressed refrigerant is cooled in the first heat exchanger;
the cooled refrigerant is expanded in at least one of the one or more expansion devices;
the expanded refrigerant absorbs heat in the second heat exchanger and returns to the first compressor; and
the second compressor is offline; and
a second mode wherein:
the second compressor compresses refrigerant;
the compressed refrigerant is cooled in the second heat exchanger;
the cooled refrigerant is expanded in at least one of the one or more expansion devices;
the expanded refrigerant absorbs heat in the first heat exchanger and returns to the second compressor; and
the first compressor is offline,
wherein:
the first compressor has a suction flowpath merging with a discharge flowpath of the second compressor at a first junction (34);
the first compressor has a discharge flowpath merging with a suction flowpath of the second compressor at a second junction (36);
a first control valve (32A) is along the first compressor discharge flowpath; and
a second control valve (32B) is along the second compressor discharge flowpath.

20. The method of claim 18 wherein:
the first mode is a cooling mode and the second mode is a heating mode.

* * * * *